US011359357B2

(12) United States Patent
Brady et al.

(10) Patent No.: US 11,359,357 B2
(45) Date of Patent: Jun. 14, 2022

(54) FREEZELESS OUTDOOR SHOWER

(71) Applicant: Prier Products, Inc., Grandview, MO (US)

(72) Inventors: Scott P. Brady, Lake Winnebago, MO (US); William C. Seitter, Overland Park, KS (US); Joseph E. Poskin, Prairie Village, KS (US)

(73) Assignee: Prier Products, Inc., Grandview, MO (US)

( * ) Notice: Subject to any disclaimer, the term of this patent is extended or adjusted under 35 U.S.C. 154(b) by 0 days.

(21) Appl. No.: 17/076,459

(22) Filed: Oct. 21, 2020

(65) Prior Publication Data

US 2022/0120061 A1 Apr. 21, 2022

(51) Int. Cl.

| | |
|---|---|
| ***E03B 7/10*** | (2006.01) |
| ***A47K 3/28*** | (2006.01) |
| ***E03B 9/14*** | (2006.01) |
| *E03B 9/02* | (2006.01) |

(52) U.S. Cl.

CPC ..... *E03B 7/10* (2013.01); *A47K 3/281* (2013.01); *E03B 9/14* (2013.01); *E03B 9/027* (2013.01)

(58) Field of Classification Search

CPC ... E03B 7/10; E03B 9/14; A47K 3/281; Y10T 137/1353

See application file for complete search history.

(56) References Cited

U.S. PATENT DOCUMENTS

| | | | | |
|---|---|---|---|---|
| 3,077,609 | A * | 2/1963 | Siline | A47K 3/285 4/617 |
| 3,121,235 | A * | 2/1964 | Gellmann | A47K 3/285 4/570 |
| 5,158,105 | A | 10/1992 | Conway | |
| 5,365,620 | A * | 11/1994 | MacLeod | A47K 3/285 4/600 |
| 5,983,419 | A * | 11/1999 | Carroll | A47K 3/285 239/280 |
| 5,996,142 | A * | 12/1999 | Colman | E03B 9/20 239/276 |
| D457,605 | S * | 5/2002 | Balish, Jr. | A47K 3/285 D23/283 |
| 7,478,645 | B2 | 1/2009 | Brady et al. | |
| D709,997 | S * | 7/2014 | Moerman | D23/283 |
| 10,563,385 | B1 * | 2/2020 | Ball | E03C 1/232 |
| 2006/0201553 | A1 * | 9/2006 | Poskin | F16K 31/508 137/360 |
| 2007/0256235 | A1 * | 11/2007 | Lin | A47K 3/285 4/599 |
| 2014/0373268 | A1 | 12/2014 | Sherman | |
| 2019/0085540 | A1 * | 3/2019 | Thadhani | E03C 1/0408 |

* cited by examiner

*Primary Examiner* — Kevin R Barss
(74) *Attorney, Agent, or Firm* — Avek IP, LLC

(57) ABSTRACT

A freezeless outdoor shower assembly that is self-draining to prevent freezing and damage to the assembly when the assembly is exposed to cold and freezing weather. The assembly includes a riser coupled to a self-draining riser coupler assembly which drains water from the assembly when water from a water source it turned off. Preferably the freezeless outdoor shower assembled is coupled to an outdoor freezeless hydrant providing hot and cold water.

13 Claims, 4 Drawing Sheets

FREEZELESS OUTDOOR SHOWER

FIELD

The present invention generally relates to showers and, more particularly, to a freezeless outdoor shower assembly that is self-draining to prevent damage to the shower assembly.

BACKGROUND

Outdoor showers are known in the art and commonly found at beaches, pools, spas or saunas in warm climates not subject to freezing temperatures. These outdoor showers may be connected to both hot and cold water supplies or only a cold water supply. In many of these prior art designs, water is temporarily supplied to the mounted shower by attaching a common garden hose to the shower at one end and a spigot at the other end. In cold weather, to prevent freezing, the hose is disconnected to drain water from the shower. If the hose is not disconnected from the shower and spigot, there is a danger of water freezing in the hose and shower assembly causing damage to the system.

Other outdoor showers have attempted to address the problem of freezing by proposing systems that are removable from the water supply and from their support structure for storage during cold weather. While these systems address the freezing and damage problem caused by water freezing, the shower assembly must be winterized, disassembled, disconnected and stored during cold weather and then reinstalled during warm weather. If the weather turns cold unexpectedly, or the system is not timely disconnected, water may still freeze in the valve and unit causing damage. Further, it may be inconvenient to repeatedly install, remove, store and reinstall the unit. The system may be damaged in storage or parts may be misplaced or lost.

As a result, there is a need for an outdoor shower assembly that is low maintenance and is self-draining to avoid freezing and damage when the system is exposed to cold and freezing weather. Further, there is a need for an outdoor shower assembly that may be left in place in colder climates without the concern for freezing or damage to the assembly.

SUMMARY

The present invention provides a freezeless outdoor shower assembly that is self-draining to prevent freezing and damage to the assembly when the assembly is exposed to cold and freezing weather. The assembly includes a self-draining riser coupler assembly, a riser and a shower head, which is coupled to a water source such as a freezeless hydrant.

DETAILED DESCRIPTION

Figure 1:
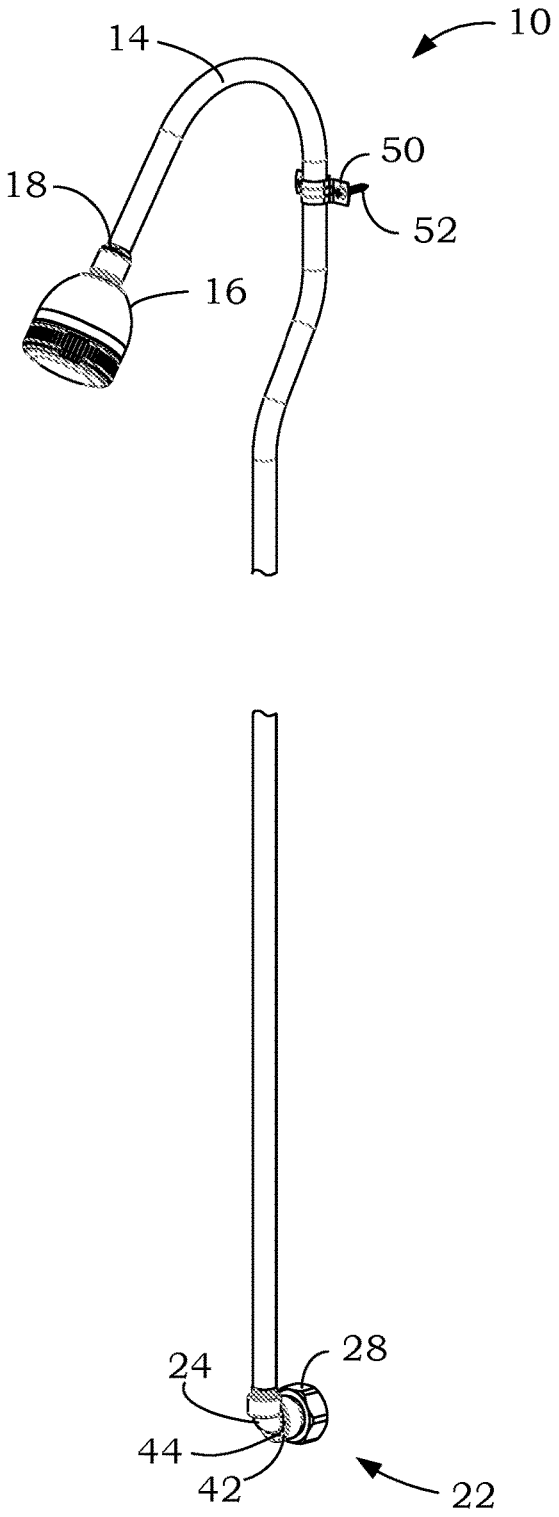
FIG. 1 is a perspective view of a freezeless outdoor shower assembly of the present invention.
Figure 2:
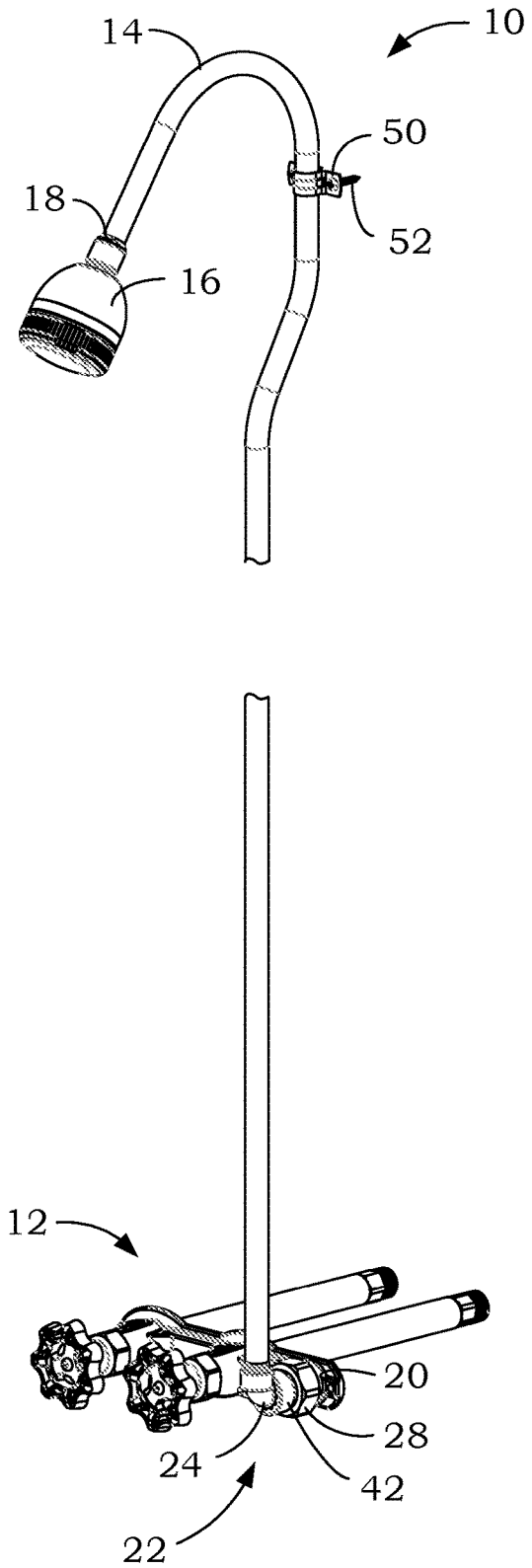
FIG. 2 is a perspective view of the freezeless outdoor shower assembly of the present invention shown in combination with a freezeless hydrant.
Figure 3:
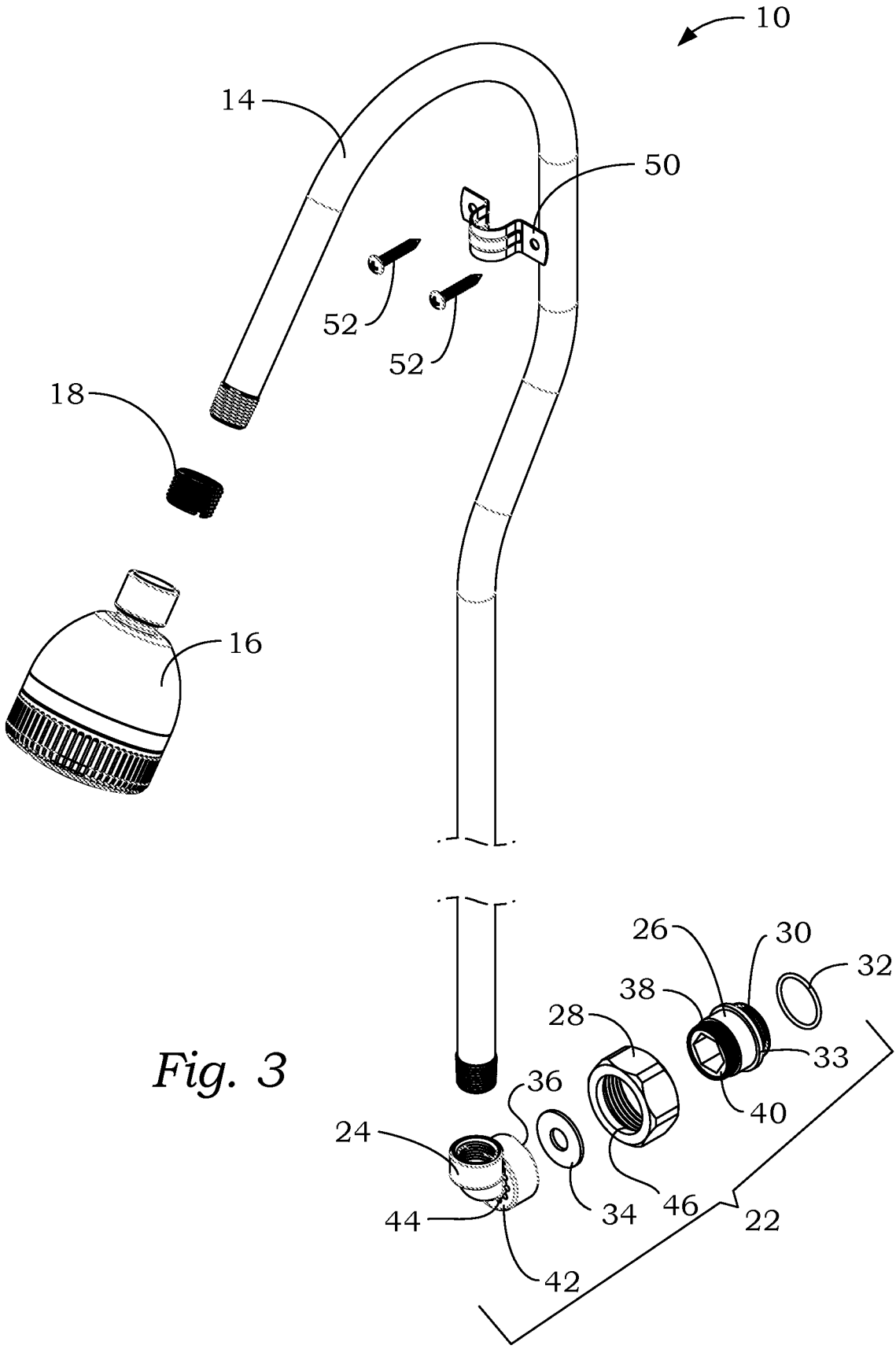
FIG. 3 is an exploded view of the freezeless outdoor shower assembly of FIG. 1.
Figure 4:
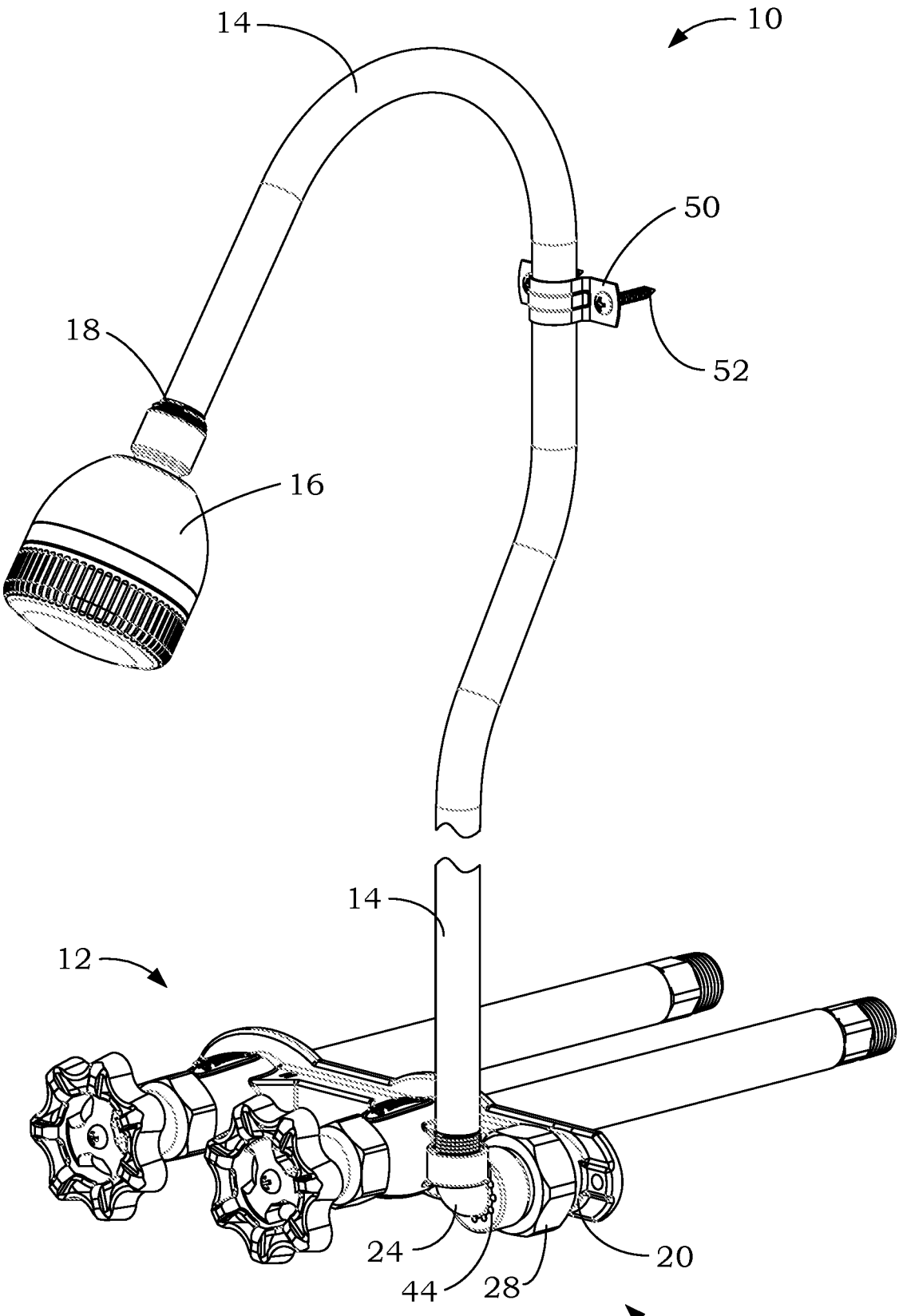
FIG. 4 is an enlarged perspective view of the freezeless outdoor shower assembly of FIG. 1 in combination with a freezeless hydrant.
Figure 5:
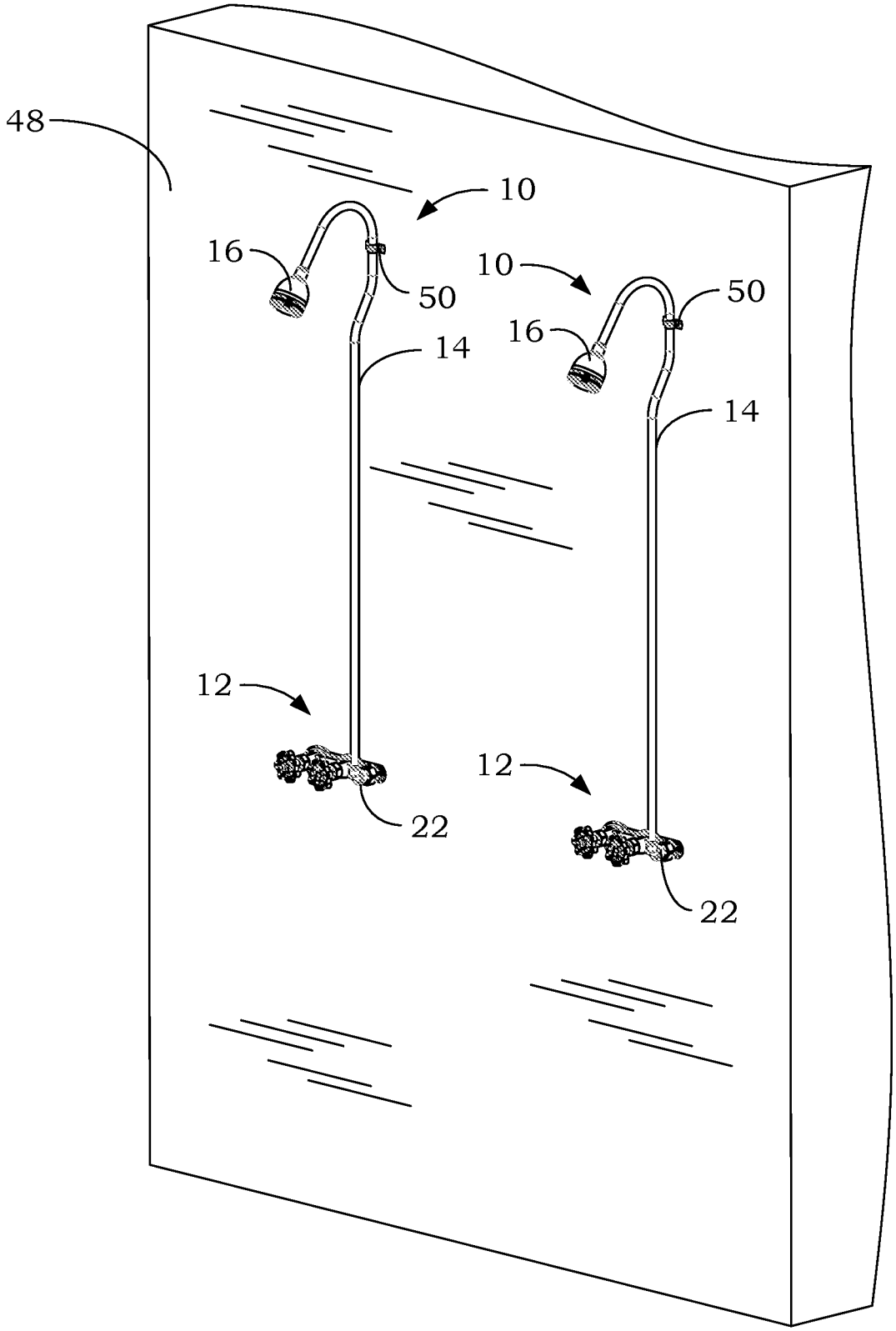
FIG. 5 is a perspective view of the freezeless outdoor shower assembly of FIG. 1 shown mounted to a wall or other structure.

As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting, but merely as a basis for the claims, and as a representative basis for teaching one skilled in the art to variously understand and employ the present invention in virtually any appropriately detailed structure.

Referring to the figures, a freezeless outdoor shower assembly of the present invention is generally indicated by reference numeral 10. Freezeless outdoor shower assembly 10 is coupled to a hot and cold water hydrant 12. Hydrant 12 is a freezeless hot and cold outdoor hydrant having a hot water inlet and a cold water inlet and a single water outlet 20. The hydrant has a hydrant body including a mix cavity chamber. The single water outlet is mounted to an end of the hydrant body such that the hydrant may be mounted in a horizontal orientation with the hot and cold water inlets horizontally oriented beside the outlet. Two horizontal orientations are possible. One horizontal orientation has the hot water operator on the left side of the hydrant and the other horizontal orientation has the hot water operator on the right side of the hydrant. A hydrant 12 is described in detail in U.S. Pat. No. 7,478,645, which is incorporated by reference. Reference to the hydrant 12 as described in U.S. Pat. No. 7,478,645 is by way of example and not limited thereto. Other freezeless hydrants may be used with the freezeless outdoor shower assembly of the present invention as desired.

The freezeless outdoor shower assembly 10 includes a shower riser 14, a shower head 16 coupled to the shower riser 14 by a face bushing 18 at an upper end of the riser 14. At the lower end of the riser 14, the riser 14 is coupled to the outlet 20 of the hydrant 12 by a riser coupler assembly 22. The riser coupler assembly 22 includes an elbow 24 coupled to the lower end of the riser 14, a shower adapter 26, and a nut 28 coupled to the outlet 20.

The shower adapter 26 includes a groove 30 to carry an O-ring 32. The nut 28 mounts over a shoulder 33 of the shower adapter 26. A washer 34 is received in a threaded female receptacle 36 of the elbow 24. The threaded boss 38 of shower adapter 26 is received in the threaded female receptacle 36 of the elbow 24. When the shower adapter 26 is tightened to the elbow 24, the washer 34 is free to move or flex within a space between the lip 40 of the shower adapter 26 and the base 42 inside the threaded female receptacle 36. The base 42 of the elbow 24 includes apertures 44 passing from the exterior of the elbow 24 to the interior of the elbow 24. The nut 28 includes threads 46. The nut 28 is tightened to the outlet 20 of the hydrant 12 to compress the O-ring 32 and seal the riser coupler assembly 22 to the hydrant outlet 20. The riser 14 may be secured to a wall 48 or other structure with a bracket 50 and fasteners 52.

Uses of the freezeless outdoor shower assembly 10 of the present invention include but are not limited to showering before or after use of a pool, sauna, or spa, or time at the beach or lake. The freezeless outdoor shower assembly 10 may be installed at a campground for showering after hiking or other outdoor activity. The freezeless outdoor shower assembly 10 may be used for showering after doing yard work such as cutting grass or working in the garden, running or exercising. The freezeless outdoor shower assembly 10 is ideal for remote locations that may be difficult to get to and thus require a self-draining system, which would prove to be very useful in climates where temperatures fall below freezing.

During use, when the hydrant 12 is turned on, water passes through the outlet 20 and through the shower adapter 26. The water pressure forces the washer 34 against the interior of base 42 blocking the apertures 44 to seal the riser coupler assembly 22. The water flows through the elbow 24, up through the riser 14 and out of the shower head 16. As long as the hydrant 12 is open, the water pressure holds the washer 34 against the interior of base 42 to seal the apertures 44.

When the hydrant 12 is turned off, the water in the riser 14 forces the washer 34 away from the base 42 of the elbow 24 unsealing the apertures 44, allowing the water in the riser 14 to drain out of the shower head 16 and out of the apertures 44 protecting the riser 14 and riser coupler assembly 22 from freezing. Water in the hydrant 12 also drains through apertures 44 protecting the hydrant from freezing.

The freezeless outdoor shower assembly 10 may be permanently installed with a freezeless hydrant 12 and require minimal maintenance. In cold months, the water supply to the hydrant 12 may be disconnected and drained to protect the water supply pipes from freezing. However, the freezeless outdoor shower assembly 10 need not be removed for cold or freezing seasons. Once installed, the freezeless outdoor shower assembly 10 may remain mounted season after season avoiding the wear and tear of repeatedly installing, uninstalling, storing then installing again. Further, the freezeless outdoor shower assembly 10 eliminates the need to monitor temperature conditions.

It is to be understood that while certain now preferred forms of this invention have been illustrated and described, it is not limited thereto except insofar as such limitations are included in the following claims. Many different arrangements of the various components depicted, as well as components not shown, are possible without departing from the scope of the claims below. Embodiments of the invention have been described with the intent to be illustrative rather than restrictive. Alternative embodiments will become apparent to readers of this disclosure after and because of reading it. Alternative means of implementing the aforementioned may be completed without departing from the scope of the claims below. Certain features and subcombinations are of utility and may be employed without reference to other features and subcombinations and are contemplated within the scope of the claims.

Having thus described the invention, what is claimed as new and desired to be secured by Letter Patent is as follows:

1. A freezeless outdoor shower assembly comprising:

a riser coupler assembly having an inlet coupled to a water source, an outlet, and an elbow fitting having an aperture, a riser having a first end coupled to said outlet of said coupler, and a second end extending upwardly from said first end, wherein water from the water source flows through said riser coupler and through said riser, and out said second end of said riser when the water source is turned on, wherein water in said riser and said riser coupler drains out said aperture of said elbow fitting when the water source is turned off.

2. The freezeless outdoor shower assembly of claim 1, wherein said elbow fitting further having a base and a receptacle, wherein said base includes said aperture.

3. The freezeless outdoor shower assembly of claim 2, wherein said riser coupler assembly further includes a shower adapter presenting said inlet of said coupler, and having a boss received in said receptacle.

4. The freezeless outdoor shower assembly of claim 3, wherein said riser coupler assembly further includes a washer received in said receptacle between said aperture and said boss of said shower adapter.

5. The freezeless outdoor shower assembly of claim 4, wherein said washer has a first position to seal said aperture when the water supply is on, and a second position to allow water to drain from said aperture when the water supply is off.

6. The freezeless outdoor shower assembly of claim 1 further comprising a shower head coupled to said second end of said riser.

7. The freezeless outdoor shower assembly of claim 1 wherein said elbow fitting includes a plurality of apertures.

8. A freezeless outdoor shower assembly comprising:

a riser coupler assembly having a shower adapter, an elbow fitting, and a washer; said shower adapter having an inlet coupled to a water source, and a boss;

said elbow fitting having an outlet, a base and a receptacle, said base having an aperture, said receptacle receiving said washer and said boss;

a riser having a first end coupled to said outlet of said elbow fitting, and a second end extending upwardly from said first end, wherein water from the water source flows through said riser coupler assembly and through said riser, and out said second end of said riser when the water source is turned on, wherein water in said riser and said riser coupler drains out said aperture when the water source is turned off.

9. The freezeless outdoor shower assembly of claim 8, wherein said washer is received in said receptacle between said aperture and said boss of said shower adapter.

10. The freezeless outdoor shower assembly of claim 8, wherein said washer has a first position to seal said aperture when the water supply is on, and a second position to allow water to drain from said aperture when the water supply is off.

11. The freezeless outdoor shower assembly of claim 8 further comprising a shower head coupled to said second end of said riser.

12. The freezeless outdoor shower assembly of claim 8 wherein said riser coupler assembly includes a plurality of apertures.

13. The freezeless outdoor shower assembly of claim 8 wherein said inlet of said shower adapter is coupled to a freezeless hydrant.

* * * * *